United States Patent [19]

Diaz et al.

[11] Patent Number: 4,524,649

[45] Date of Patent: Jun. 25, 1985

[54] ELECTRIC SOCKET WRENCH

[76] Inventors: Joe Diaz, c/o George Spector, 3615 Woolworth Bldg., 233 Broadway; George Spector, 3615 Woolworth Bldg., 233 Broadway, both of New York, N.Y. 10007

[21] Appl. No.: 459,365

[22] Filed: Jan. 19, 1983

[51] Int. Cl.[3] ..... B25B 17/00

[52] U.S. Cl. ..... 81/57.13; 81/57.29

[58] Field of Search ..... 81/57.13, 57.11, 57.12, 81/57.14, 57.29

[56] References Cited

U.S. PATENT DOCUMENTS

| | | | |
|---|---|---|---|
| 2,808,749 | 10/1957 | Lampke | 81/57.13 |
| 2,979,089 | 4/1961 | Piesker | 81/57.11 |
| 3,016,775 | 1/1962 | Calkins | 81/57.13 |
| 4,078,589 | 3/1978 | Miller | 81/57.14 |
| 4,215,601 | 8/1980 | Mann | 81/57.13 |

*Primary Examiner*—James L. Jones, Jr.

[57] ABSTRACT

An electric socket wrench is provided and consists of a housing having a tubular head and a tubular neck, power means provided in the housing, a power driven shaft extending from the power means through the tubular neck into the tubular head, transmission means for rotating a socket driving member for attachment to a standard socket member placed within the tubular head and connected to the power driven shaft and locking means for preventing rotation of the socket driving member so that the wrench can be used manually.

3 Claims, 5 Drawing Figures

ELECTRIC SOCKET WRENCH

BACKGROUND OF THE INVENTION

The instant invention relates generally to wrenches and more specifically it relates to an electric socket wrench.

Removing and replacing lug nuts on cars and truck wheels have always presented problems when using standard lug wrenches by many drivers, especially women, because of the strength required for this job. Service stations use air socket wrenches but they require a compressor to run them which is not practicable. This situation is not desirable and accordingly is in need of an improvement.

SUMMARY OF THE INVENTION

A principal object of the present invention is to provide an electric socket wrench that is driven by a motor and controlled with a three position selector switch.

Another object is to provide an electric socket wrench that can be locked electrically and mechanically so that the wrench can be used manually for tight bolts or lugs.

An additional object is to provide an electric socket wrench that can be designed to fit into a person's hand comfortably when used.

A further object is to provide an electric socket wrench that is economical in cost to manufacture.

A still further object is to provide an electric socket wrench that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
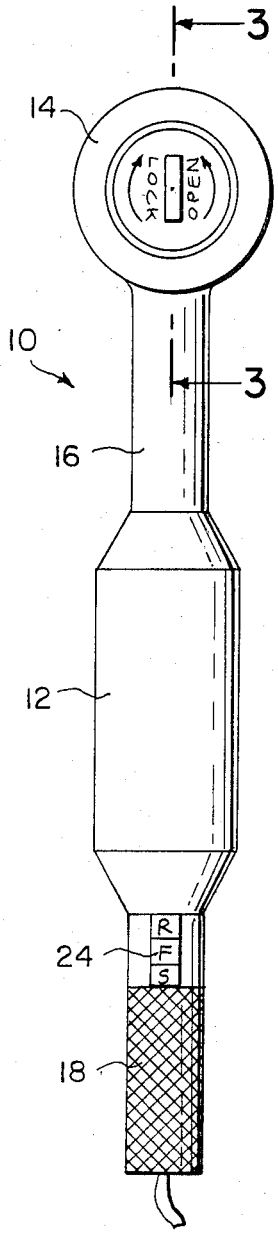
FIG. 1 is a front elevational view of the invention.
Figure 2:
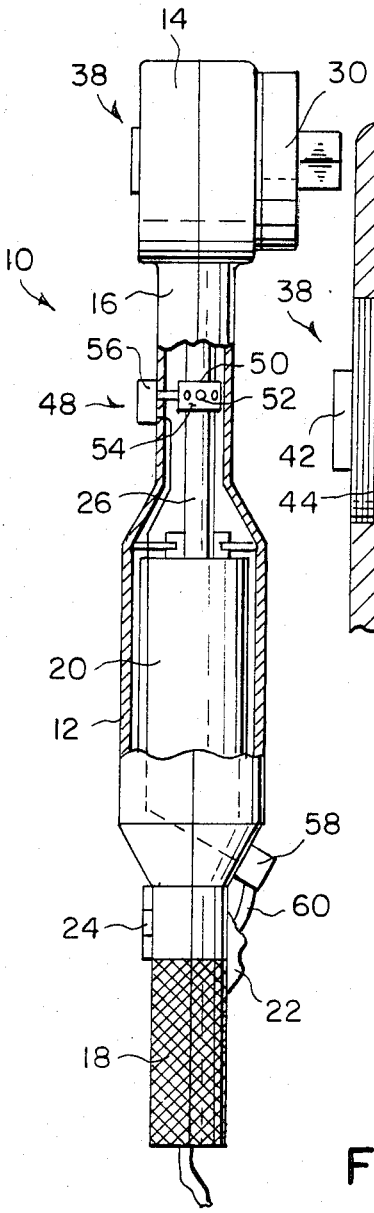
FIG. 2 is a side elevational view partly in section.
Figure 3:
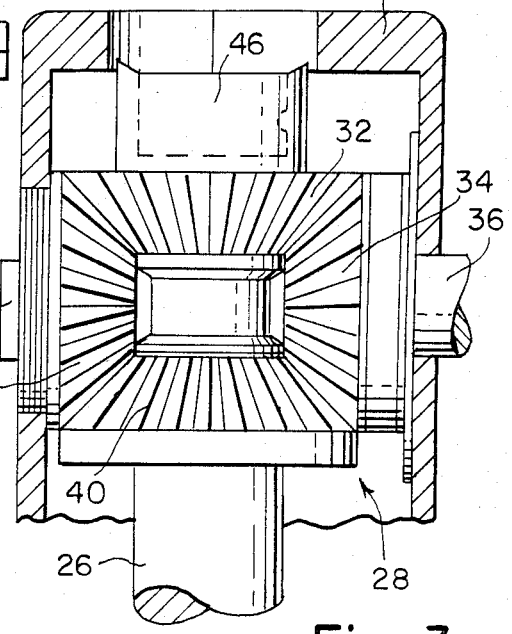
FIG. 3 is an enlarged cross sectional view taken along line 3—3 in FIG. 1.

Turning now descriptively to the drawings, in which similar reference characters denote similar elements throughout the several views, FIGS. 1 through 3 illustrates an electric socket wrench 10. The wrench 10 consists of a housing 12 of any suitable material but metallic is preferable. It may be made in halves and secured together by friction securing means such as screws or the like (not shown). A tubular head 14 having a tubular neck 16 is provided at one end of the housing 12 and a knurled handle 18 is received on the other end of the housing 12.

A power means 20, preferably a reversible electric motor controlled by an on-off switch 22 and a three position slow, fast and reverse selector switch 24 is provided in the housing 12. A power driven shaft 26 extends from the motor 20 through the tubular neck 16 into the tubular head 14.

The head 14 is provided therein with a transmission means 28 for rotating the usual hexagonal socket driving member 30 for attachment to standard socket members not shown. The transmission means 28 comprises a first bevel gear 32 affixed to the power driven shaft 26 within the head 14. The bevel gear 32 meshes with a second bevel gear 34 in one end of the head 14 concentric thereto whereby the bevel gear 34 is affixed to a shaft 36 connected to the socket driving member 30.

The head 14 is also provideed therein with a locking means 38 for preventing the rotation of the socket driving member 30 so that the wrench 10 can be used manually. The locking means 38 comprises a free rolling third bevel gear 40 placed onto the power driven shaft 26 below the first bevel gear 32 so that the bevel gear 40 will rotate in the opposite direction of the bevel gear 32. A turn knob 42 threadably engages the other end of the head 14 and is concentric thereto. The turn knob 42 has a fourth bevel gear 44 that can mesh and lock with the first bevel gear 32 and the free rolling third bevel gear 40. Turn knob 42 will (via its threaded connection to head 14) engage or disengage bevel gear 44 with bevel gears 32 and 40. When it is desired to use the wrench manually turn knob 42 is rotated to cause gear 44 to engage both gears 40 and 32 whereby manual rotation of the wrench about the axis of shaft 36 will cause gear 44 to react and exert a counter-clockwise turning pressure on gear 40, whereas gear 34 will react to cause a clockwise turning pressure on gear 40. The oppositely reacting pressures on gear 40 by gears 44 and 34 will thus lock gear 40 from rotation about shaft 26 and result in operative torque being exerted on shaft 36. The head 14 is also provided with a socket 46 attached to the first bevel gear 32 so that a flexible shaft or an extension socket (not shown) can be connected thereto.

Figure 4:
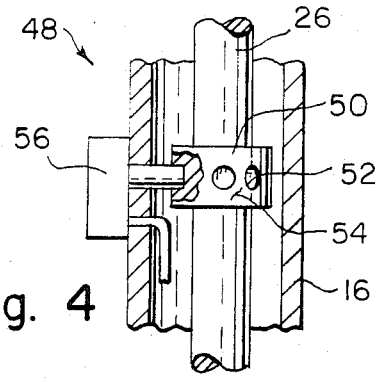
FIG. 4 is an enlarged detail view of a modified form of the invention shown in FIG. 2.
Figure 5:
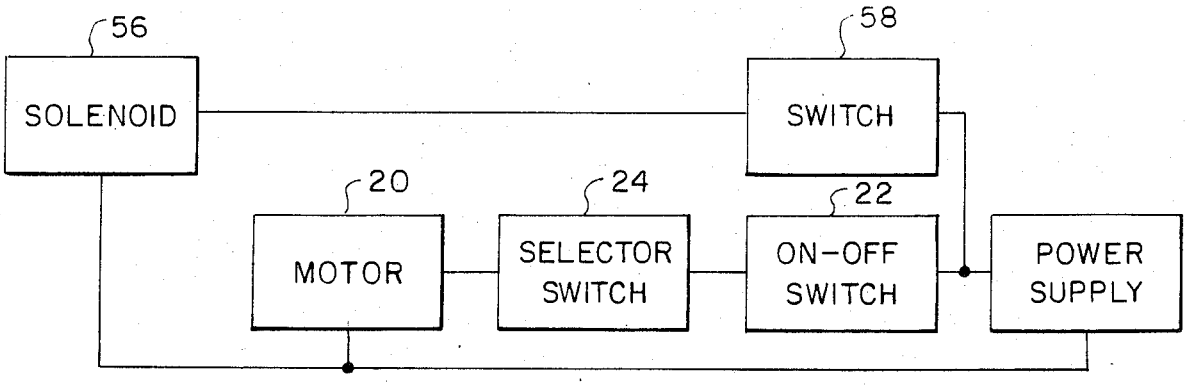
FIG. 5 is a block diagram of the electrical system of the invention.

FIGS. 2 and 4 show an additional locking means 48 for preventing the rotation of the socket driving member 30. The locking means 48 consists of a hub 50 having a plurality of apertures 52 around its circumference 54 mounted midway on the power driven shaft 26 within the tubular neck 16. A solenoid 56 is mounted on the tubular neck 16 so that when the solenoid 56 is activated it can engage one of the apertures 52 on the hub 50 whereby the power driven shaft 26 will not rotate. A switch 58 placed adjacent to the on-off switch 22 is electrically connected to the solenoid 56. A stop 60 is affixed to the switch 58 so that when the switch 58 is closed the stop 60 will engage the on-off switch 22 keeping the switch 22 in an open position. In this way the wrench 10 can be locked electrically and mechanically at the same time so that the motor 20 will not be damaged.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An electric socket wrench which comprises:

(A) a housing having a tubular head and a tubular neck;

(B) power means provided in the housing;

(C) A power driven shaft extending from the power means through the tubular neck into the tubular head;

(D) Transmission means for rotating a plurality of driving shafts mounted within the tubular head on said power driven shaft, whereby said driving shafts extend from said housing at right angles to each other in combination with additional means mounted on said housing coacting with the first said means to lock the said shafts from rotation, wherein the transmission means comprises:

(A) A first bevel gear affixed to the power driven shaft within the head;

(B) A second bevel gear rotatably mounted on one side of said head that meshes with said first bevel gear;

(C) One of said driving shafts affixed to the second bevel gear and connected to a socket driving member, wherein said additional means comprises:

(A) A free rolling third bevel gear mounted on the power driven shaft spaced inwardly of said first bevel gear meshing with said second gear so that the third bevel gear will rotate in an opposite direction of the first bevel gear;

(B) A turn knob threadably mounted on said head having a fourth bevel gear connected to the turn knob that meshes and locks with both said first bevel gear and said free rolling third bevel gear.

2. An electric socket wrench as recited in claim 1, wherein the locking means further comprises:

(A) a hub having a plurality of apertures around its circumference mounted midway on the power driven shaft within the tubular neck;

(B) A solenoid mounted on the tubular neck so that when the solenoid is activated it can engage one of the apertures on the hub whereby the power driven shaft will not rotate;

(C) A switch placed adjacent to the on-off switch and electrically connected to the solenoid; and (D) A stop affixed to the switch so that when the switch is closed the stop will engage the on-off switch keeping the on-off switch in an open position whereby the wrench can be locked electrically and mechanically at the same time preventing damage to the motor.

3. An electric wrench as recited in claim 2, that further comprises a socket attached to the first bevel gear so that a flexible shaft can be connected thereto.

* * * * *